US011749903B2

(12) United States Patent
Chan et al.

(10) Patent No.: US 11,749,903 B2
(45) **Date of Patent: *Sep. 5, 2023**

(54) ANTENNA STRUCTURE

(71) Applicant: COMPAL ELECTRONICS, INC., Taipei (TW)

(72) Inventors: Chun-Cheng Chan, Taipei (TW); Shih-Chia Liu, Taipei (TW); Yen-Hao Yu, Taipei (TW); Li-Chun Lee, Taipei (TW); Jui-Hung Lai, Taipei (TW); Chih-Heng Lin, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 86 days.

This patent is subject to a terminal disclaimer.

(21) Appl. No.: 17/374,954

(22) Filed: Jul. 13, 2021

(65) Prior Publication Data

US 2021/0344119 A1 Nov. 4, 2021

Related U.S. Application Data

(63) Continuation-in-part of application No. 16/995,784, filed on Aug. 17, 2020, now Pat. No. 11,588,244.
(Continued)

(51) Int. Cl.

| | |
|---|---|
| ***H01Q 1/52*** | (2006.01) |
| ***H01Q 21/06*** | (2006.01) |
| ***H01Q 1/48*** | (2006.01) |

(52) U.S. Cl.
CPC ..... *H01Q 21/06* (2013.01); *H01Q 1/48* (2013.01)

(58) Field of Classification Search
CPC ..... H01Q 21/06; H01Q 1/48; H01Q 21/28; H01Q 1/521; H01Q 1/52; H01Q 1/36; H01Q 1/50
See application file for complete search history.

(56) References Cited

U.S. PATENT DOCUMENTS

| | | | | |
|---|---|---|---|---|
| 11,588,244 | B2 * | 2/2023 | Chan | H01Q 9/42 |
| 2016/0285161 | A1 * | 9/2016 | Apaydin | H01Q 1/525 |

(Continued)

FOREIGN PATENT DOCUMENTS

| | | |
|---|---|---|
| TW | 201507268 | 2/2015 |
| TW | M593665 | 4/2020 |

OTHER PUBLICATIONS

"Office Action of Taiwan Counterpart Application", dated May 9, 2022, p. 1-p. 6.

*Primary Examiner* — David E Lotter
(74) *Attorney, Agent, or Firm* — JCIPRNET

(57) ABSTRACT

The disclosure provides an antenna structure including a ground plane, a first coupling antenna and a reference antenna. The first coupling antenna includes a first excitation source connected to the ground plane. The first excitation source is configured to excite a first resonant mode, and the first coupling antenna forms a first zero current area on the ground plane in response to the first resonant mode. The reference antenna includes a second excitation source connected to the ground plane. The second excitation source is configured to excite a second resonant mode, and the reference antenna forms a second zero current area on the ground plane in response to the second resonant mode. The first excitation source is located in the second zero current area, and the second excitation source is located in the first zero current area.

16 Claims, 9 Drawing Sheets

Related U.S. Application Data

(60) Provisional application No. 63/053,694, filed on Jul. 19, 2020.

(56) References Cited

U.S. PATENT DOCUMENTS

| | | | | |
|---|---|---|---|---|
| 2017/0062932 | A1* | 3/2017 | Foster | H01Q 1/38 |
| 2021/0126368 | A1* | 4/2021 | Hsiao | H01Q 1/48 |

* cited by examiner

ANTENNA STRUCTURE

CROSS-REFERENCE TO RELATED APPLICATION

This application is a continuation-in-part application of and claims the priority benefit of U.S. application Ser. No. 16/995,784, filed on Aug. 17, 2020, now pending. The prior U.S. application Ser. No. 16/995,784 claims the priority benefit of Taiwan applications serial no. 109106932, filed on Mar. 3, 2020. This application also claims the priority benefits of U.S. provisional application Ser. No. 63/053,694, filed on Jul. 19, 2020. The entirety of each of the above-mentioned patent applications is hereby incorporated by reference herein and made a part of this specification.

BACKGROUND

Technical Field

The disclosure relates to an antenna structure, in particular to a multi-antenna structure with high isolation.

Description of Related Art

In existing technology, in order to reduce the size of the antenna, a ¼-wavelength resonance structure such as a planar inverted-F antenna (PIFA) and a coupling antenna is often used, and a ¼-wavelength resonance structure for increasing isolation is also added between the two antennas. In addition, the existing technology also uses the configuration of ½-wavelength closed slot antenna and ¼-wavelength PIFA adjacent to each other to achieve favorable isolation by taking advantage of their different electrical properties.

However, in the above two cases, the antennas have to be arranged together, which may result in the overall antenna structure occupying a larger space.

SUMMARY

The disclosure provides an antenna structure capable of solving the above technical problems.

The disclosure provides an antenna structure including a ground plane, a first coupling antenna and a reference antenna. The first coupling antenna includes a first excitation source connected to the ground plane. The first excitation source is configured to excite a first resonant mode, and the first coupling antenna forms a first zero current area on the ground plane in response to the first resonant mode. The reference antenna includes a second excitation source connected to the ground plane. The second excitation source is configured to excite a second resonant mode, and the reference antenna forms a second zero current area on the ground plane in response to the second resonant mode. The first excitation source is located in the second zero current area, and the second excitation source is located in the first zero current area.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
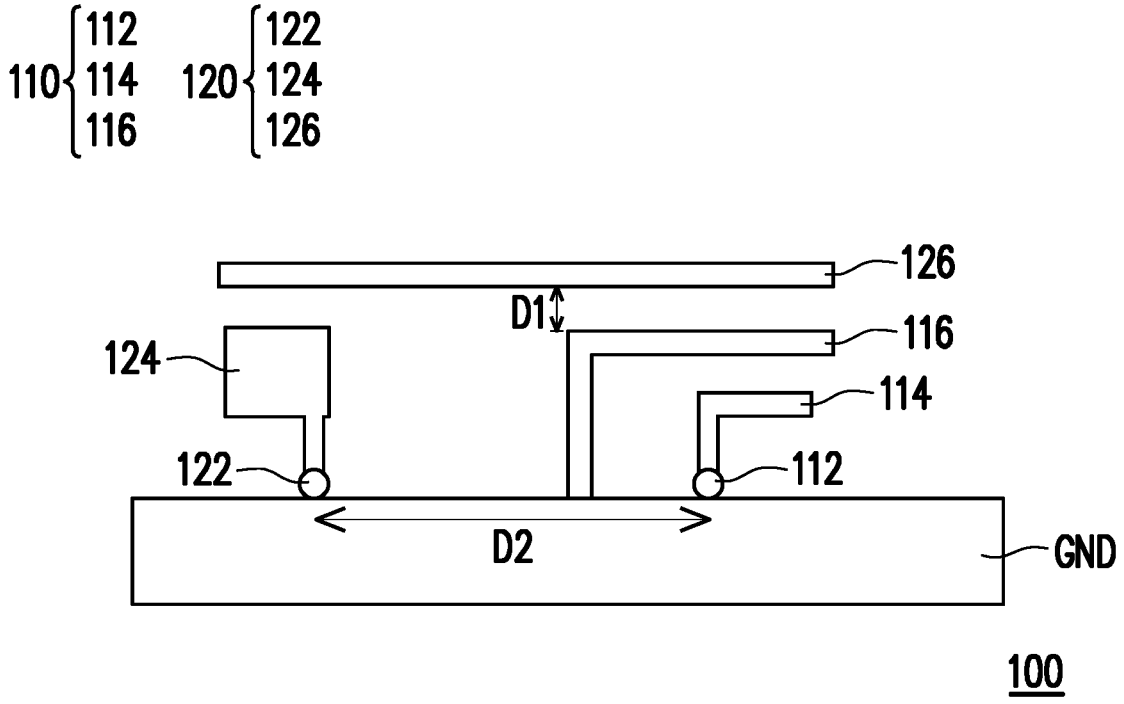
FIG. 1A is a schematic diagram of an antenna structure according to a first embodiment of the disclosure.

FIG. 1A is a schematic diagram of an antenna structure according to a first embodiment of the disclosure. In FIG. 1A, an antenna structure 100 includes a first coupling antenna 110 and a reference antenna 120. The first coupling antenna 110 includes a first excitation source 112, a first feeding portion 114, and a first radiator 116. The first excitation source 112 is connected to a ground plane GND and the first feeding portion 114, and may be configured to excite a first resonant mode. In addition, the first radiator 116 may be coupled to the ground plane GND, and may generate a current by being coupled to an excited first excitation source 112 and the first feeding portion 114.

According to this embodiment, the reference antenna 120 is, for example, a second coupling antenna, and may include a second excitation source 122, a second feeding portion 124, and a second radiator 126. The second excitation source 122 is connected to the ground plane GND and the second feeding portion 124, and is configured to excite a second resonant mode. According to the first embodiment, the second radiator 126 may generate a current by being coupled to an excited second excitation source 122 and the second feeding portion 124.

According to the first embodiment, a first distance D1 (which is, for example, a shortest distance between the first radiator 116 and the second radiator 126) may exist between the first radiator 116 and the second radiator 126, and a second distance D2 may exist between the first excitation source 112 and the second excitation source 122. The first distance D1 may not be greater than the second distance D2. In addition, the first radiator 116 may be a ¼-wavelength resonance structure, and the second radiator 126 may be a double-end opening ½-wavelength resonance structure. A fundamental resonance frequency of the second radiator 126 may be same as a fundamental resonance frequency of the first radiator 116.

Figure 1B:
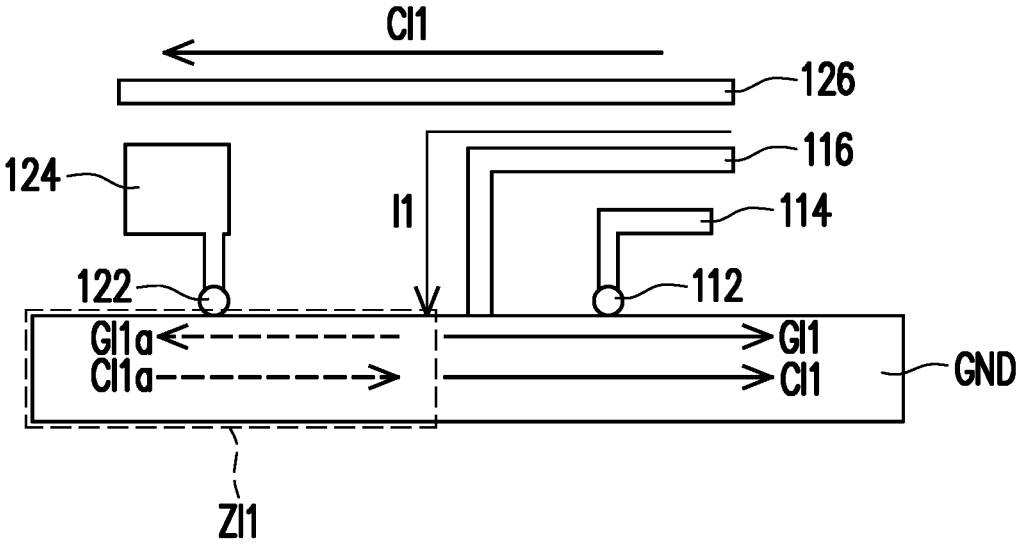
FIG. 1B is a schematic diagram of formation of a first zero current area according to FIG. 1A.

According to the first embodiment, the first coupling antenna 110 may form a first zero current area on the ground plane GND in response to the first resonant mode excited by the first excitation source 112, which is further described in detail with respect to FIG. 1B. The reference antenna 120 may form a second zero current area on the ground plane GND in response to the second resonant mode excited by the second excitation source 122, which is further described in detail with respect to FIG. 1C. According to embodiments of the disclosure, the so-called zero current area is, for example, an area where no current is flowing or an area where very little current is flowing.

According to the first embodiment, the first excitation source 112 may be designed to be located in the second zero current area corresponding to the reference antenna 120, and the second excitation source 122 may be designed to be located in the first zero current area corresponding to the first coupling antenna. In this way, isolation between the first coupling antenna 110 and the reference antenna 120 may be increased to further avoid interference between the first coupling antenna 110 and the reference antenna 120.

FIG. 1B is a schematic diagram of formation of a first zero current area according to FIG. 1A. In FIG. 1B, when the first excitation source 112 is excited, the first feeding portion 114 may be coupled to the first radiator 116 to excite the first resonant mode, and a first current I1 is formed on the first radiator 116. The first current I1 may flow into the ground plane GND to form a first ground current GI1.

As shown in FIG. 1B, the first ground current GI1 may generally flow toward a right side of the figure, but a part of the first ground current GI1 (i.e., a current GI1*a*) may flow toward a left side of the figure, but not limited thereto.

In addition, when the first excitation source 112 is excited, the second radiator 126 and the ground plane GND may generate a first coupling current CI1 in response to the first current I1. In this case, since a part of the first coupling current CI1 of the ground plane GND (i.e., a current CI1*a*) flows in an opposite direction to the part of the first ground current GI1 (i.e., the current GI1*a*), the current CI1*a* may offset the current GI1*a* and a first zero current area ZI1 on the ground plane GND is formed.

Figure 1C:
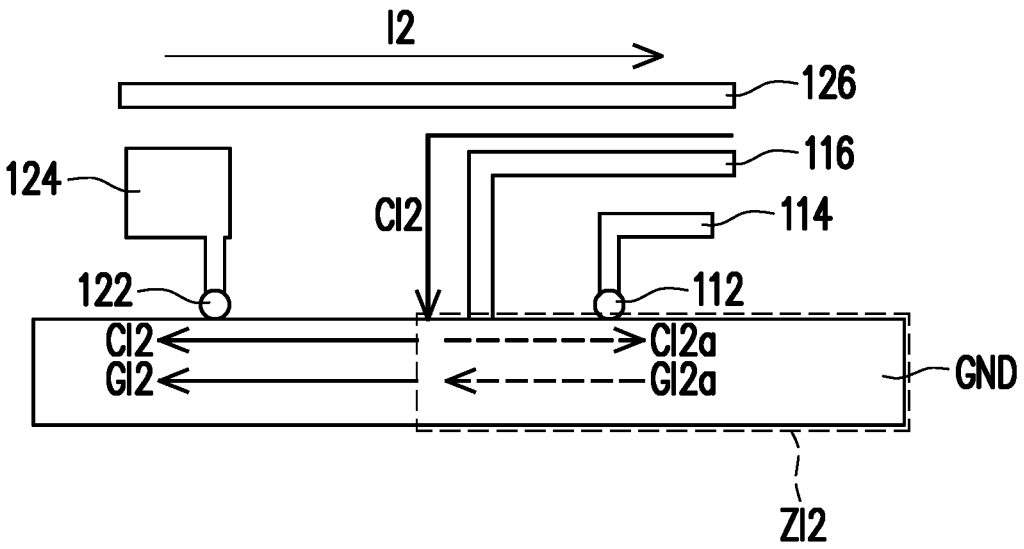
FIG. 1C is a schematic diagram of formation of a second zero current area according to FIG. 1A.

FIG. 1C is a schematic diagram of formation of a second zero current area according to FIG. 1A. In FIG. 1C, when the second excitation source 122 is excited, the second feeding portion 124 may be coupled to the second radiator 126 to excite the second resonant mode, and a second current I2 is formed on the second radiator 126. In addition, the ground plane GND may form a second ground current GI2 in response to the second current I2.

Correspondingly, the first radiator 116 may form a second coupling current CI2 flowing on the first radiator 116 and the ground plane GND in response to the second current I2. In scenario of FIG. 1C, the second coupling current CI2 flowing on the ground plane GND may generally flow toward a left side of the figure, but a part of the second coupling current CI2 (i.e., a current CI2*a*) may flow toward a right side of the figure, but not limited thereto. In this case, since the part of the second coupling current CI2 (i.e., the current CI2*a*) flowing on the ground plane GND flows in an opposite direction to a part of the second ground current GI2 (i.e., a current GI2*a*), the current CI2*a* may offset the current GI2*a* and a second zero current area ZI2 on the ground plane GND is formed.

As can be seen from FIG. 1B and FIG. 1C, the first excitation source 112 may be designed to be located in the second zero current area ZI2, and the second excitation source 122 may be located in the first zero current area ZI1 to increase the isolation between the first coupling antenna 110 and the reference antenna 120.

Figure 2:
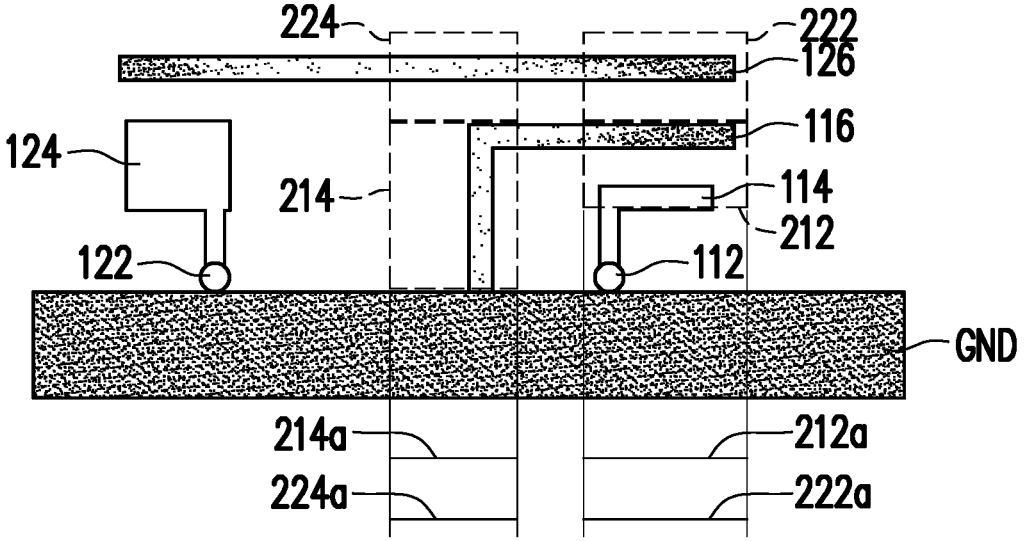
FIG. 2 is a schematic diagram illustrating intensity distribution of an electric field according to scenario of FIG. 1B.

According to the first embodiment, a relative position between the first coupling antenna 110 and the reference antenna 120 may be specially designed to ensure the isolation between the first coupling antenna 110 and the reference antenna 120. FIG. 2 is a schematic diagram illustrating intensity distribution of an electric field according to scenario of FIG. 1B. According to this embodiment, a darker area represents a stronger electric field strength (i.e., a weaker current), and vice versa.

In FIG. 2, the first radiator 116 may have at least a first strong current zone 214 and a first weak current zone 212 in response to the first current I1. A (average) current in the first weak current zone 212 may be lower than a (average) current in the first strong current zone 214. In other words, an (average) intensity of an electric field corresponding to the first weak current zone 212 may be higher than an (average) intensity of an electric field corresponding to the first strong current zone 214. Similarly, the second radiator 126 may have at least a second strong current zone 224 and a second weak current zone 222 in response to the first coupling current CI1. A (average) current in the second weak current zone 222 may be lower than a (average) current in the second strong current zone 224. In other words, an (average) intensity of an electric field corresponding to the second weak current zone 222 may be higher than an (average) intensity of an electric field corresponding to the second strong current zone 224.

As shown in FIG. 2, a vertical projection 212*a* of the first weak current zone 212 on the ground plane GND may at least partially overlap a vertical projection 222*a* of the second weak current zone 222 on the ground plane GND. In addition, a vertical projection 214*a* of the first strong current zone 214 on the ground plane GND may at least partially overlap a vertical projection 224*a* of the second strong current zone 224 on the ground plane GND.

From another point of view, the above concept may be used as a principle to determine location/direction of an open terminal of the first radiator 116. For example, the open terminal of the first radiator 116 may be approximately aligned with an area of the second radiator 126 having same electric field state. As can be seen from FIG. 2, since a right side of the second radiator 126 is the second weak current zone 222 (which can be understood as a strong electric field), the open terminal of the first radiator 116 (which belongs to the current weak current zone 212) may be designed to be approximately aligned with the right side of the second radiator 126. At the same time, since a middle of the second radiator 126 is the second strong current zone 224 (which can be understood as a weak electric field), an area of the first radiator 116 currently corresponding to the first strong current zone 214 may be designed to be approximately aligned with the middle of the second radiator 126, but not limited thereto.

According to other embodiments, when the second excitation source 122 is excited (i.e., in the scenario of FIG. 1C), a corresponding diagram illustrating intensity distribution of an electric field may also be generated. In this case, the first radiator 116 may have at least a third strong current zone and a third weak current zone in response to the second coupling current CI2, and the second radiator 126 may have at least a fourth strong current zone and a fourth weak current zone in response to the second current I2.

According to the first embodiment, a vertical projection of the third weak current zone on the ground plane GND may at least partially overlap a vertical projection of the fourth weak current zone on the ground plane GND. In addition, a vertical projection of the third strong current zone on the ground plane GND may at least partially overlap a vertical projection of the fourth strong current zone on the ground plane GND, but not limited thereto.

Figure 3:
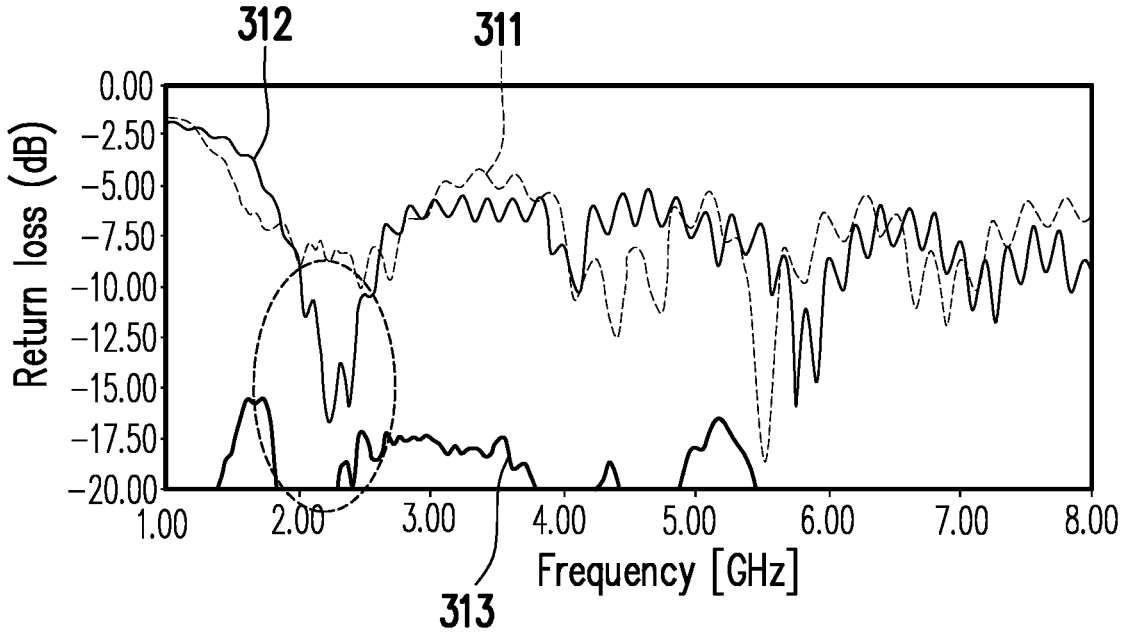
FIG. 3 is a diagram of antenna performance according to the first embodiment of the disclosure.

FIG. 3 is a diagram of antenna performance according to the first embodiment of the disclosure. In FIG. 3, a curve 311 and a curve 312 are return loss curves of the first coupling antenna 110 and the reference antenna 120, respectively, and a curve 313 is an isolation curve between the first coupling antenna 110 and the reference antenna 120.

As shown in FIG. 3, the first coupling antenna 110 and the reference antenna 120 are well isolated from each other at the fundamental resonance frequency of the first coupling antenna 110 and the reference antenna 120 (i.e., at a dotted circle), and therefore do not cause excessive interference to each other. It can be seen that by disposing the first excitation source 112 in the second zero current area ZI2 and disposing the second excitation source 122 in the first zero current area ZI1, the isolation between the first coupling antenna 110 and the reference antenna 120 may indeed be increased, thereby improving performance of the antenna structure 100.

Figure 4A:
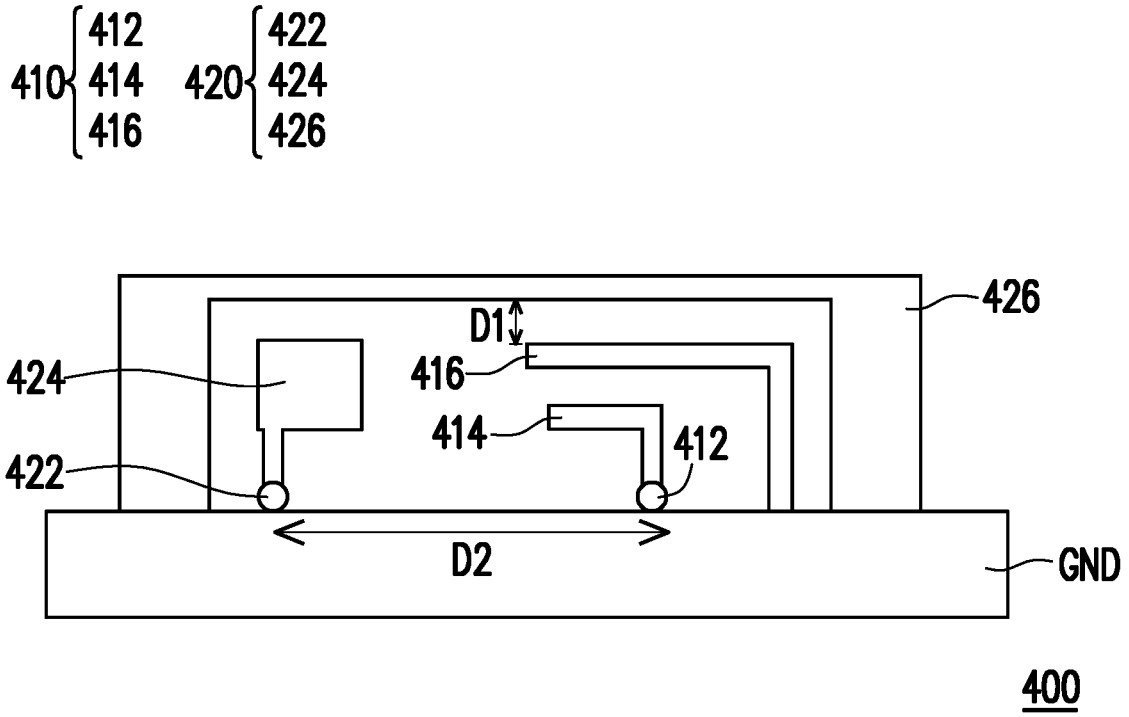
FIG. 4A is a schematic diagram of an antenna structure according to a second embodiment of the disclosure.

FIG. 4A is a schematic diagram of an antenna structure according to a second embodiment of the disclosure. In FIG. 4A, an antenna structure 400 includes a first coupling antenna 410 and a reference antenna 420. The first coupling antenna 410 includes a first excitation source 412, a first feeding portion 414, and a first radiator 416. The first excitation source 412 is connected to a ground plane GND and the first feeding portion 414, and may be configured to excite a first resonant mode. In addition, the first radiator 416 may be coupled to the ground plane GND, and may generate a current by being coupled to an excited first excitation source 412 and the first feeding portion 414.

According to this embodiment, the reference antenna 420 is, for example, a second coupling antenna, and may include a second excitation source 422, a second feeding portion 424, and a second radiator 426. The second excitation source 422 is connected to the ground plane GND and the second feeding portion 424, and is configured to excite a second resonant mode. According to the second embodiment, the second radiator 426 may generate a current by being coupled to an excited second excitation source 422 and the second feeding portion 424.

According to the second embodiment, a first distance D1 (which is, for example, a shortest distance between the first radiator 416 and the second radiator 426) may exist between the first radiator 416 and the second radiator 426, and a second distance D2 may exist between the first excitation source 412 and the second excitation source 422. The first distance D1 may not be greater than the second distance D2. In addition, the first radiator 416 may be a ¼-wavelength resonance structure, and the second radiator 426 may be a double-end shorting ½-wavelength resonance structure. A fundamental resonance frequency of the second radiator 426 may be same as a fundamental resonance frequency of the first radiator 416.

Figure 4B:
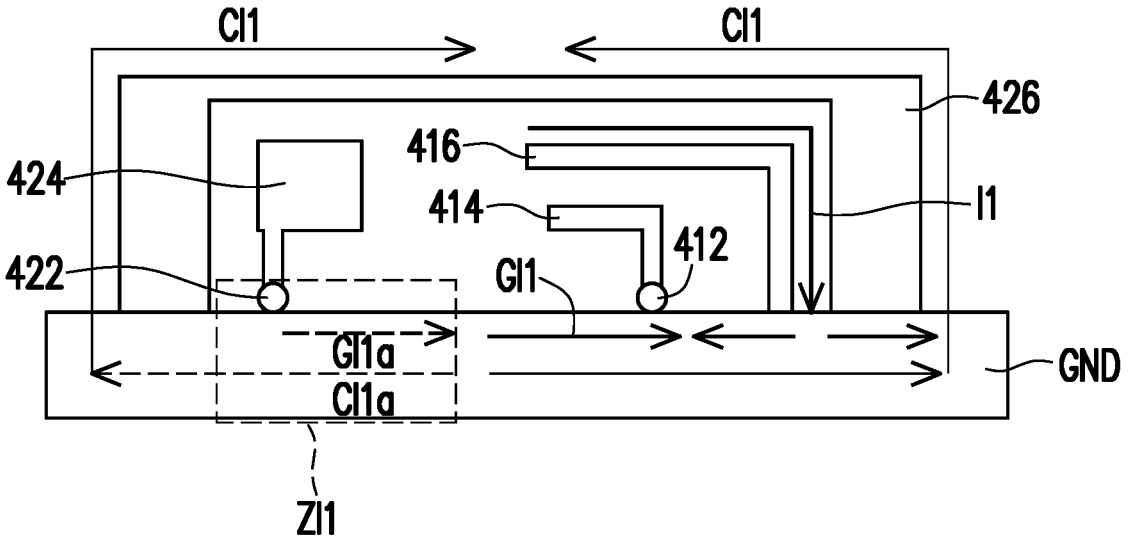
FIG. 4B is a schematic diagram of formation of a first zero current area according to FIG. 4A.

According to the second embodiment, the first coupling antenna 410 may form a first zero current area on the ground plane GND in response to the first resonant mode excited by the first excitation source 412, which is further described in detail with respect to FIG. 4B. The reference antenna 420 may form a second zero current area on the ground plane GND in response to the second resonant mode excited by the second excitation source 422, which is further described in detail with respect to FIG. 4C. According to embodiments of the disclosure, the so-called zero current area is, for example, an area where no current is flowing or an area where very little current is flowing.

According to the second embodiment, the first excitation source 412 may be designed to be located in the second zero current area corresponding to the reference antenna 420, and the second excitation source 422 may be designed to be located in the first zero current area corresponding to the first coupling antenna. In this way, isolation between the first coupling antenna 410 and the reference antenna 420 may be increased to further avoid interference between the first coupling antenna 410 and the reference antenna 420.

FIG. 4B is a schematic diagram of formation of a first zero current area according to FIG. 4A. In FIG. 4B, when the first excitation source 412 is excited, the first feeding portion 414 may be coupled to the first radiator 416 to excite the first resonant mode, and a first current I1 is formed on the first radiator 416. The first current I1 may flow into the ground plane GND to form a first ground current GI1.

In addition, when the first excitation source 412 is excited, the second radiator 426 and the ground plane GND may generate a first coupling current CI1 in response to the first current I1. In this case, since a part of the first coupling current CI1 of the ground plane GND (i.e., a current CI1*a*) flows in an opposite direction to the part of the first ground current GI1 (i.e., a current GI1*a*), the current CI1*a* may offset the current GI1*a* and a first zero current area ZI1 on the ground plane GND is formed.

Figure 4C:
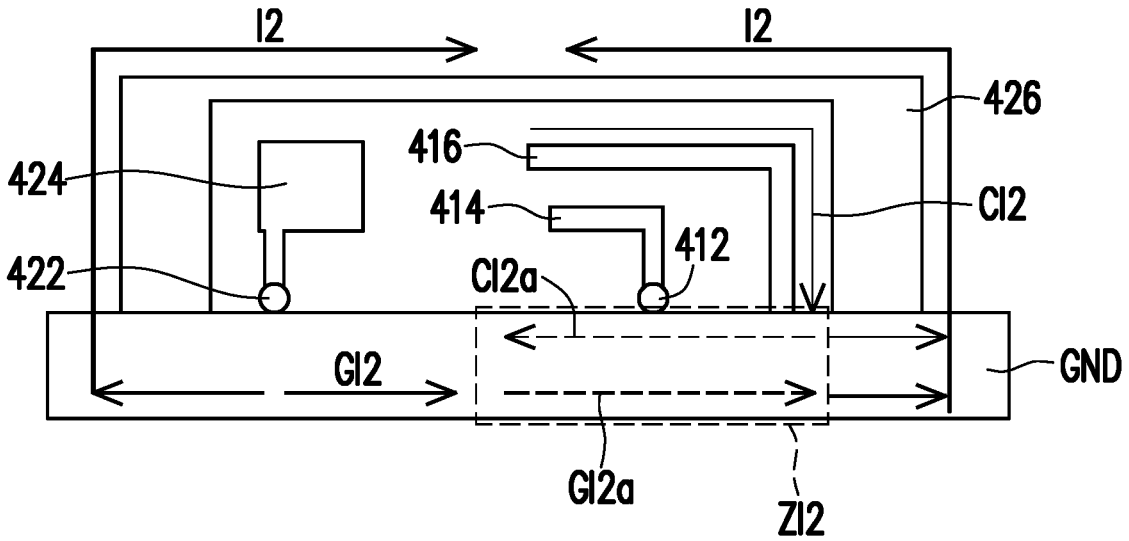
FIG. 4C is a schematic diagram of formation of a second zero current area according to FIG. 4A.

FIG. 4C is a schematic diagram of formation of a second zero current area according to FIG. 4A. In FIG. 4C, when the second excitation source 422 is excited, the second feeding portion 424 may be coupled to the second radiator 426 to excite the second resonant mode, and a second current I2 is formed on the second radiator 426. In addition, the ground plane GND may form a second ground current GI2 in response to the second current I2.

Correspondingly, the first radiator 416 may form a second coupling current CI2 flowing on the first radiator 416 and the ground plane GND in response to the second current I2. In this case, since a part of the second coupling current CI2 (i.e., a current CI2*a*) flowing on the ground plane GND flows in an opposite direction to a part of the second ground current GI2 (i.e., a current GI2*a*), the current CI2*a* may offset the current GI2*a* and a second zero current area ZI2 on the ground plane GND is formed.

As can be seen from FIG. 4B and FIG. 4C, the first excitation source 412 may be designed to be located in the second zero current area ZI2, and the second excitation source 422 may be located in the first zero current area ZI1 to increase the isolation between the first coupling antenna 410 and the reference antenna 420.

Figure 5:
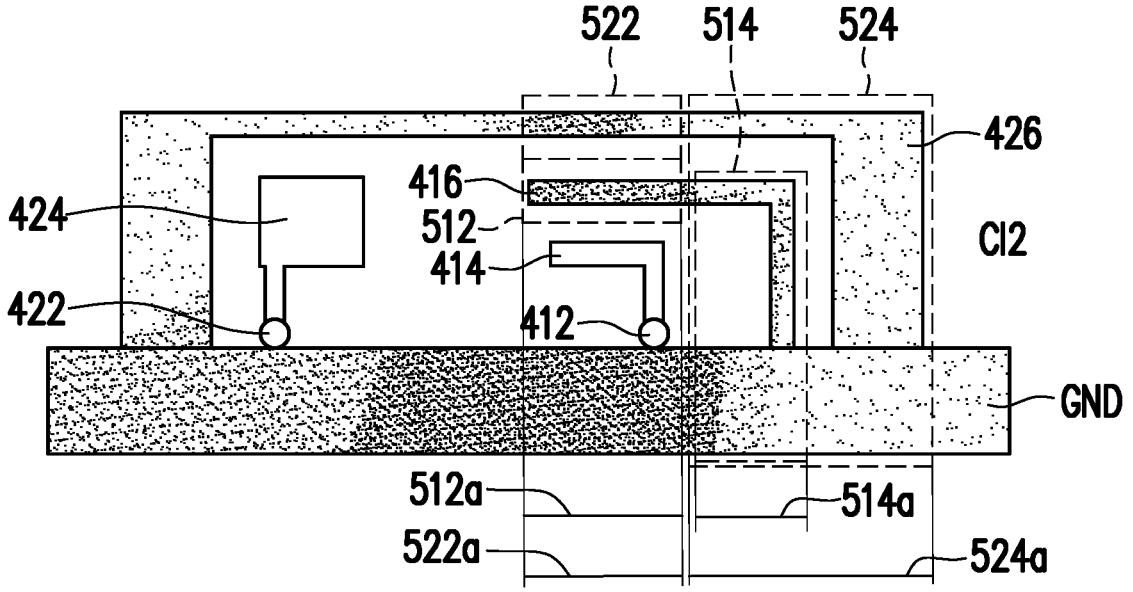
FIG. 5 is a schematic diagram illustrating intensity distribution of an electric field according to scenario of FIG. 4B.

According to the second embodiment, a relative position between the first coupling antenna 410 and the reference antenna 420 may be specially designed to ensure the isolation between the first coupling antenna 410 and the reference antenna 420. FIG. 5 is a schematic diagram illustrating intensity distribution of an electric field according to scenario of FIG. 4B. According to this embodiment, a darker area represents a stronger electric field strength (i.e., a weaker current), and vice versa.

In FIG. 5, the first radiator 416 may have at least a first strong current zone 514 and a first weak current zone 512 in response to the first current I1. A (average) current in the first weak current zone 512 may be lower than a (average) current in the first strong current zone 514. In other words, an (average) intensity of an electric field corresponding to the first weak current zone 512 may be higher than an (average) intensity of an electric field corresponding to the first strong current zone 514. Similarly, the second radiator 426 may have at least a second strong current zone 524 and a second weak current zone 522 in response to the first coupling current CI1. A (average) current in the second weak current zone 522 may be lower than a (average) current in the second strong current zone 524. In other words, an (average) intensity of an electric field corresponding to the second weak current zone 522 may be higher than an (average) intensity of an electric field corresponding to the second strong current zone 524.

As shown in FIG. 5, a vertical projection 512*a* of the first weak current zone 512 on the ground plane GND may at least partially overlap a vertical projection 522*a* of the second weak current zone 522 on the ground plane GND. In addition, a vertical projection 514*a* of the first strong current zone 514 on the ground plane GND may at least partially overlap a vertical projection 524*a* of the second strong current zone 524 on the ground plane GND.

From another point of view, the above concept may be used as a principle to determine location/direction of an open terminal of the first radiator 416. For example, the open terminal of the first radiator 416 may be approximately aligned with an area of the second radiator 426 having same electric field state. As can be seen from FIG. 5, since a middle of the second radiator 426 is the second weak current zone 522 (which can be understood as a strong electric field), the open terminal of the first radiator 416 (which belongs to the current weak current zone 512) may be designed to be approximately aligned with the middle of the second radiator 426. At the same time, since a right side of the second radiator 426 is the second strong current zone 524 (which can be understood as a weak electric field), an area of the first radiator 416 currently corresponding to the first strong current zone 514 may be designed to be approximately aligned with the right side of the second radiator 426, but not limited thereto.

According to other embodiments, when the second excitation source 422 is excited (i.e., in scenario of FIG. 4C), a corresponding diagram illustrating intensity distribution of an electric field may also be generated. In this case, the first radiator 416 may have at least a third strong current zone and a third weak current zone in response to the second coupling current CI2, and the second radiator 426 may have at least a fourth strong current zone and a fourth weak current zone in response to the second current I2.

According to the second embodiment, a vertical projection of the third weak current zone on the ground plane GND may at least partially overlap a vertical projection of the fourth weak current zone on the ground plane GND. In addition, a vertical projection of the third strong current zone on the ground plane GND may at least partially overlap a vertical projection of the fourth strong current zone on the ground plane GND, but not limited thereto.

Figure 6:
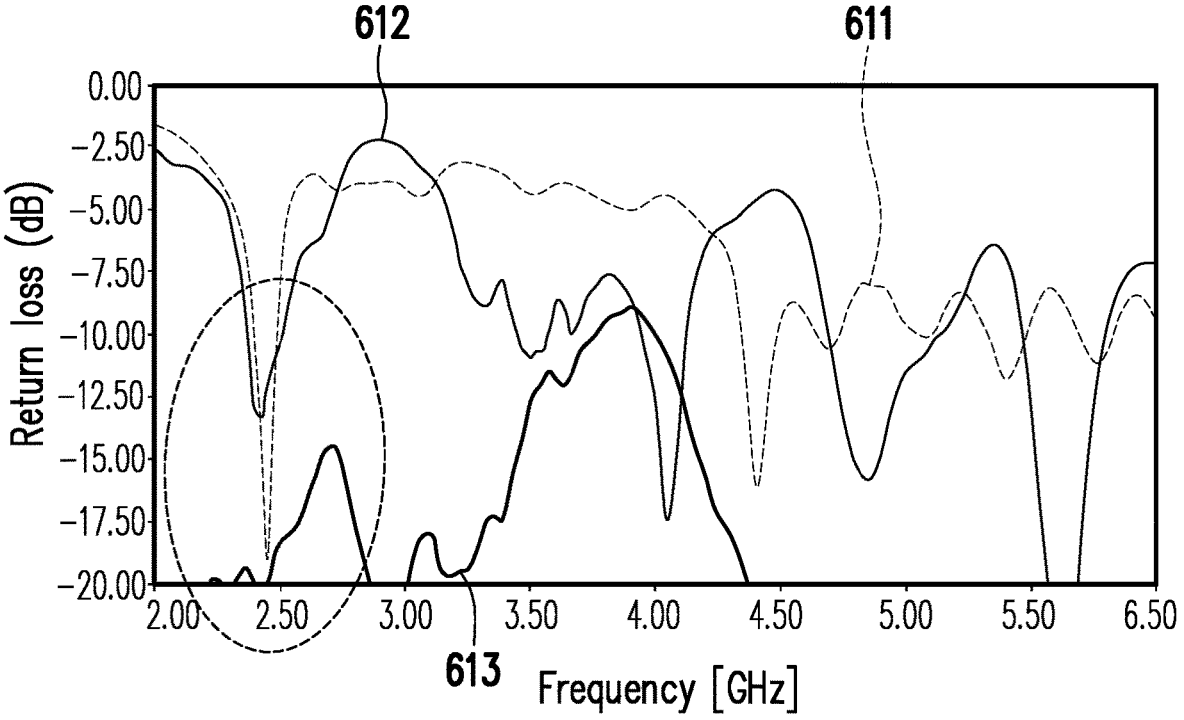
FIG. 6 is a diagram of antenna performance according to the second embodiment of the disclosure.

FIG. 6 is a diagram of antenna performance according to the second embodiment of the disclosure. In FIG. 6, a curve 611 and a curve 612 are return loss curves of the first coupling antenna 410 and the reference antenna 420, respectively, and a curve 613 is an isolation curve between the first coupling antenna 410 and the reference antenna 420.

As shown in FIG. 6, the first coupling antenna 410 and the reference antenna 420 are well isolated from each other at the fundamental resonance frequency of the first coupling antenna 410 and the reference antenna 420 (i.e., at a dotted circle), and therefore do not cause excessive interference to each other. It can be seen that by disposing the first excitation source 412 in the second zero current area ZI2 and disposing the second excitation source 422 in the first zero current area ZI1, the isolation between the first coupling antenna 410 and the reference antenna 420 may indeed be increased, thereby improving performance of the antenna structure 400.

Figure 7A:
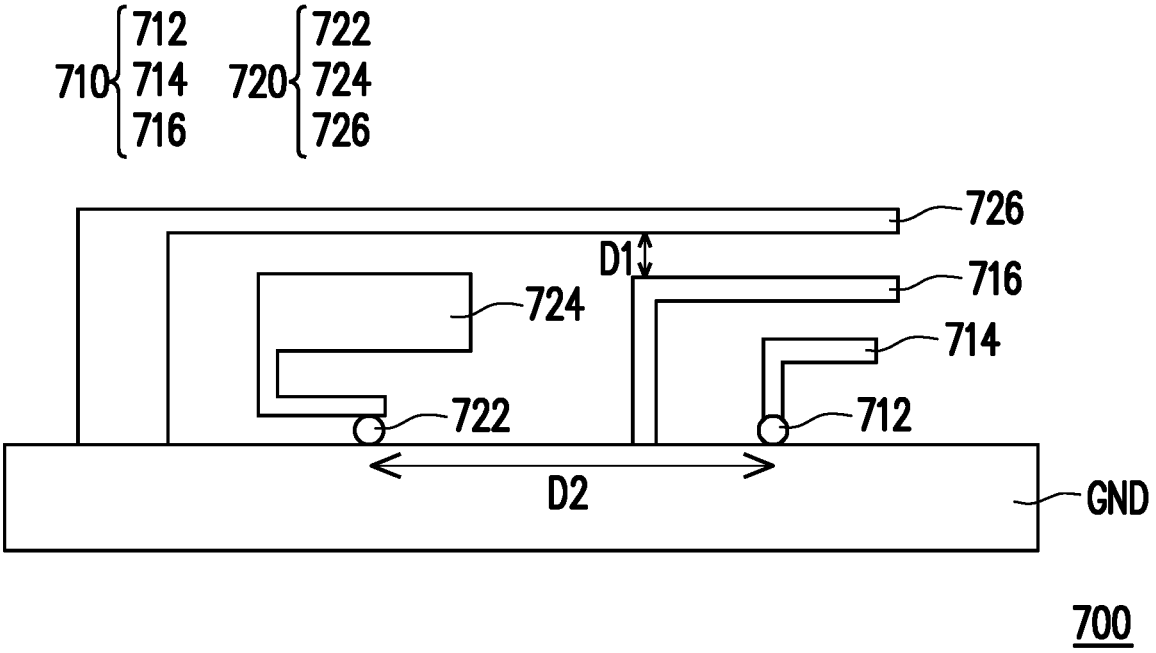
FIG. 7A is a schematic diagram of an antenna structure according to a third embodiment of the disclosure.

FIG. 7A is a schematic diagram of an antenna structure according to a third embodiment of the disclosure. In FIG. 7A, an antenna structure 700 includes a first coupling antenna 710 and a reference antenna 720. The first coupling antenna 710 includes a first excitation source 712, a first feeding portion 714, and a first radiator 716. The first excitation source 712 is connected to the ground plane GND and the first feeding portion 714, and may be configured to excite a first resonant mode. In addition, the first radiator 716 may be coupled to the ground plane GND, and may generate a current by being coupled to an excited first excitation source 712 and the first feeding portion 714.

According to this embodiment, the reference antenna 720 is, for example, a second coupling antenna, and may include a second excitation source 722, a second feeding portion 724, and a second radiator 726. The second excitation source 722 is connected to the ground plane GND and the second feeding portion 724, and is configured to excite a second resonant mode. According to the third embodiment, the second radiator 726 may generate a current by being coupled to an excited second excitation source 722 and the second feeding portion 724.

According to the third embodiment, a first distance D1 (which is, for example, a shortest distance between the first radiator 716 and the second radiator 726) may exist between the first radiator 716 and the second radiator 726, and a second distance D2 may exist between the first excitation source 712 and the second excitation source 722. The first distance D1 may not be greater than the second distance D2. In addition, the first radiator 716 may be a ¼-wavelength resonance structure, and the second radiator 726 may be a ¼-wavelength resonance structure. One terminal of the second radiator 726 may be connected to the ground plane GND, and an other terminal of the second radiator 726 may be an open terminal. In addition, a harmonic resonance frequency of the second radiator 726 (for example, a $3^{rd}$ harmonic resonance frequency) may be same as a fundamental resonance frequency of the first radiator 716.

Figure 7B:
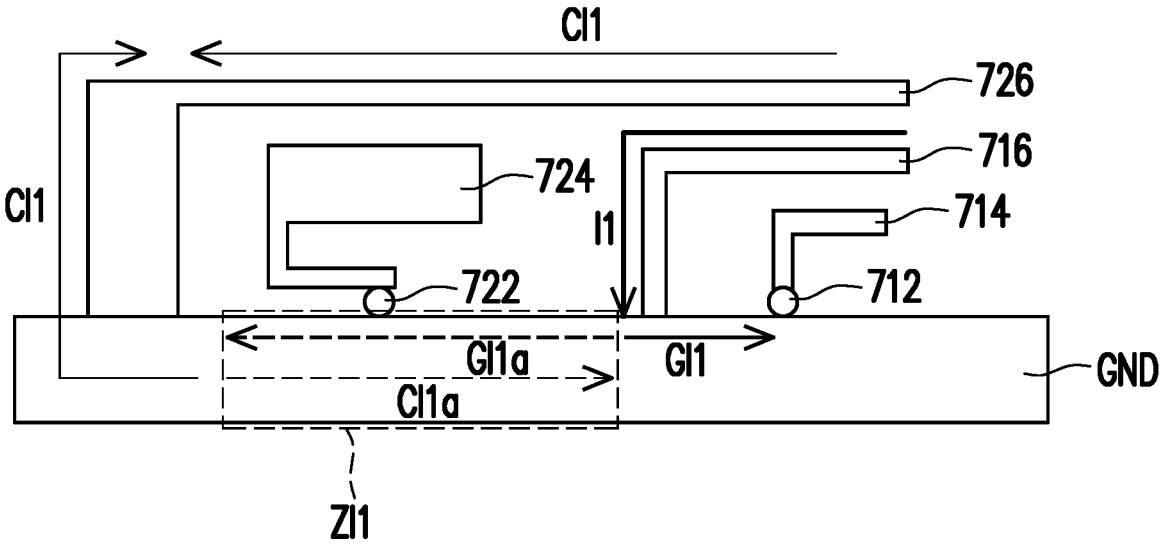
FIG. 7B is a schematic diagram of formation of a first zero current area according to FIG. 7A.

According to the third embodiment, the first coupling antenna 710 may form a first zero current area on the ground plane GND in response to the first resonant mode excited by the first excitation source 712, which is further described in detail with respect to FIG. 7B. The reference antenna 720 may form a second zero current area on the ground plane GND in response to the second resonant mode excited by the second excitation source 722, which is further described in detail with respect to FIG. 7C. According to embodiments of the disclosure, the so-called zero current area is, for example, an area where no current is flowing, or an area where very little current is flowing.

According to the third embodiment, the first excitation source 712 may be designed to be located in the second zero current area corresponding to the reference antenna 720, and the second excitation source 722 may be designed to be located in the first zero current area corresponding to the first coupling antenna. In this way, isolation between the first coupling antenna 710 and the reference antenna 720 may be increased to further avoid interference between the first coupling antenna 710 and the reference antenna 720.

FIG. 7B is a schematic diagram of formation of a first zero current area according to FIG. 7A. In FIG. 7B, when the first excitation source 712 is excited, the first feeding portion 714 may be coupled to the first radiator 716 to excite the first resonant mode, and the first current I1 is formed on the first radiator 716. The first current I1 may flow into the ground plane GND to form a first ground current GI1.

As shown in FIG. 7B, the first ground current GI1 may generally flow toward a right side of the figure, but a part of the first ground current GI1 (i.e., a current GI1*a*) may flow toward a left side of the figure, but not limited thereto.

In addition, when the first excitation source 712 is excited, the second radiator 726 and the ground plane GND may generate a first coupling current CI1 in response to the first current I1. In this case, since a part of the first coupling current CI1 of the ground plane GND (i.e., a current CI1*a*) flows in an opposite direction to the part of the first ground current GI1 (i.e., a current GI1*a*), the current CI1*a* may offset the current GI1*a* and a first zero current area ZI1 on the ground plane GND is formed.

Figure 7C:
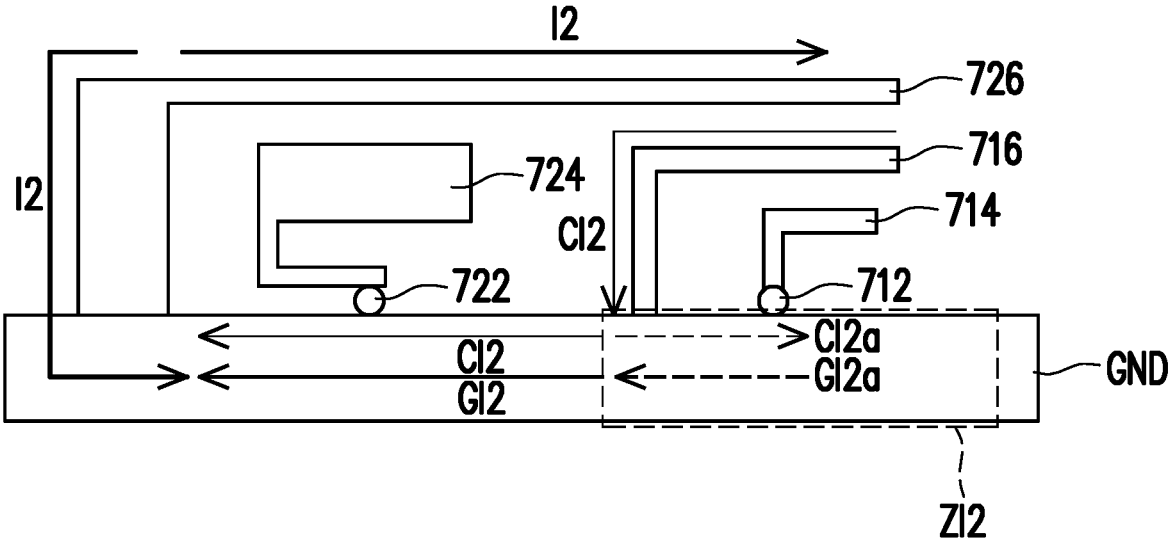
FIG. 7C is a schematic diagram of formation of a second zero current area according to FIG. 7A.

FIG. 7C is a schematic diagram of formation of a second zero current area according to FIG. 7A. In FIG. 7C, when the second excitation source 722 is excited, the second feeding portion 724 may be coupled to the second radiator 726 to excite the second resonant mode, and a second current I2 is formed on the second radiator 726. In addition, the ground plane GND may form a second ground current GI2 in response to the second current I2.

Correspondingly, the first radiator 716 may form a second coupling current CI2 flowing on the first radiator 716 and the ground plane GND in response to the second current I2. In this case, since a part of the second coupling current CI2 (i.e., a current CI2*a*) flowing on the ground plane GND flows in an opposite direction to a part of the second ground current GI2 (i.e., a current GI2*a*), the current CI2*a* may offset the current GI2*a* and a second zero current area ZI2 on the ground plane GND is formed.

As can be seen from FIG. 7B and FIG. 7C, the first excitation source 712 may be designed to be located in the second zero current area ZI2, and the second excitation source 722 may be located in the first zero current area ZI1 to increase the isolation between the first coupling antenna 710 and the reference antenna 720.

Figure 8:
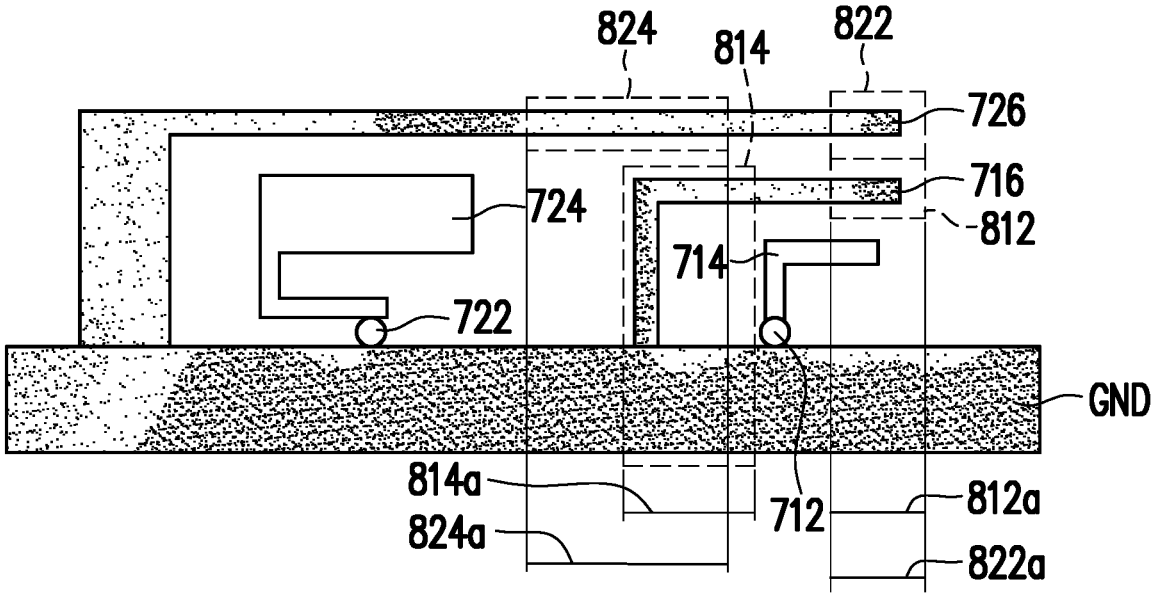
FIG. 8 is a schematic diagram illustrating intensity distribution of an electric field according to scenario of FIG. 7B.

According to the third embodiment, a relative position between the first coupling antenna 710 and the reference antenna 720 may be specially designed to ensure the isolation between the first coupling antenna 710 and the reference antenna 720. FIG. 8 is a schematic diagram illustrating intensity distribution of an electric field according to scenario of FIG. 7B. According to this embodiment, a darker area represents a stronger electric field strength (i.e., a weaker current), and vice versa.

In FIG. 8, the first radiator 716 may have at least a first strong current zone 814 and a first weak current zone 812 in response to the first current I1. A (average) current in the first weak current zone 812 may be lower than a (average) current in the first strong current zone 814. In other words, an (average) intensity of an electric field corresponding to the first weak current zone 812 may be higher than an (average) intensity of an electric field corresponding to the first strong current zone 814. Similarly, the second radiator 726 may have at least a second strong current zone 824 and a second weak current zone 822 in response to the first coupling current CI1. A (average) current in the second weak current zone 822 may be lower than the (average) current in the second strong current zone 824. In other words, an (average) intensity of an electric field corresponding to the second weak current zone 822 may be higher than an (average) intensity of an electric field corresponding to the second strong current zone 824.

As shown in FIG. 8, a vertical projection 812*a* of the first weak current zone 812 on the ground plane GND may at least partially overlap a vertical projection 822*a* of the second weak current zone 822 on the ground plane GND. In addition, a vertical projection 814*a* of the first strong current zone 814 on the ground plane GND may at least partially overlap a vertical projection 824*a* of the second strong current zone 824 on the ground plane GND.

From another point of view, the above concept can be used as a principle to determine location/direction of an open terminal of the first radiator 716. For example, the open terminal of the first radiator 716 may be approximately aligned with an area of the second radiator 726 having same electric field state. As can be seen from FIG. 8, since a right side of the second radiator 726 is the second weak current zone 822 (which can be understood as a strong electric field), the open terminal of the first radiator 716 (which belongs to the current weak current zone 812) may be designed to be approximately aligned with the right side of the second radiator 726. At the same time, since a middle of the second radiator 726 is the second strong current zone 824 (which can be understood as a weak electric field), an area of the first radiator 716 currently corresponding to the first strong current zone 814 may be designed to be approximately aligned with the middle of the second radiator 726, but not limited thereto.

According to other embodiments, when the second excitation source 722 is excited (i.e., in scenario of FIG. 7C), a corresponding diagram illustrating intensity distribution of an electric field may also be generated. In this case, the first radiator 716 may have at least a third strong current zone and a third weak current zone in response to the second coupling current CI2, and the second radiator 726 may have at least a fourth strong current zone and a fourth weak current zone in response to the second current I2.

According to the third embodiment, a vertical projection of the third weak current zone on the ground plane GND may at least partially overlap a vertical projection of the fourth weak current zone on the ground plane GND. In addition, a vertical projection of the third strong current zone on the ground plane GND may at least partially overlap a vertical projection of the fourth strong current zone on the ground plane GND, but not limited thereto.

Figure 9:
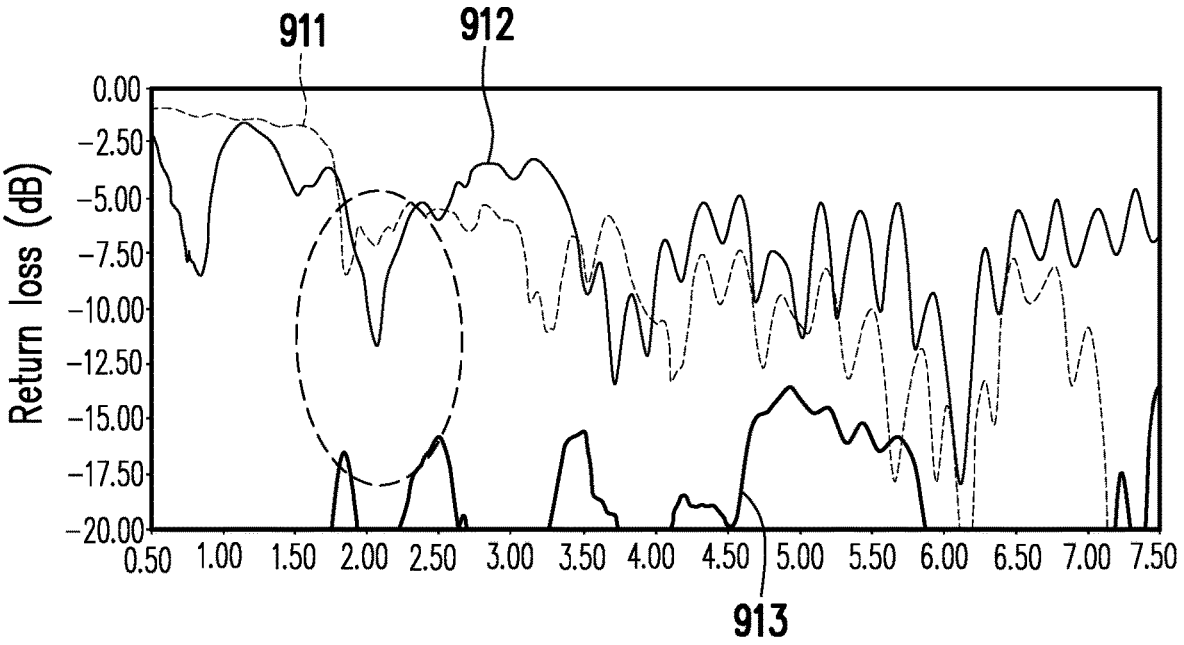
FIG. 9 is a diagram of antenna performance according to the third embodiment of the disclosure.

FIG. 9 is a diagram of antenna performance according to the third embodiment of the disclosure. In FIG. 9, a curve 911 and a curve 912 are return loss curves of the first coupling antenna 710 and the reference antenna 720, respectively, and a curve 913 is an isolation curve between the first coupling antenna 710 and the reference antenna 720.

As shown in FIG. 9, the first coupling antenna 710 and the reference antenna 720 are well isolated from each other at the fundamental resonance frequency of the first coupling antenna 710 and the $3^{rd}$ harmonic resonance frequency of the reference antenna 720 (i.e., at a dotted circle), and therefore do not cause excessive interference to each other. It can be seen that by disposing the first excitation source 712 in the second zero current area ZI2 and disposing the second excitation source 722 in the first zero current area ZI1, the isolation between the first coupling antenna 710 and the reference antenna 720 may indeed be increased, thereby improving performance of the antenna structure 700.

It should be noted that although the reference antenna is assumed to be a second coupling antenna according to the above embodiments, according to other embodiments, the reference antenna may also be other types of antennas.

Figure 10:
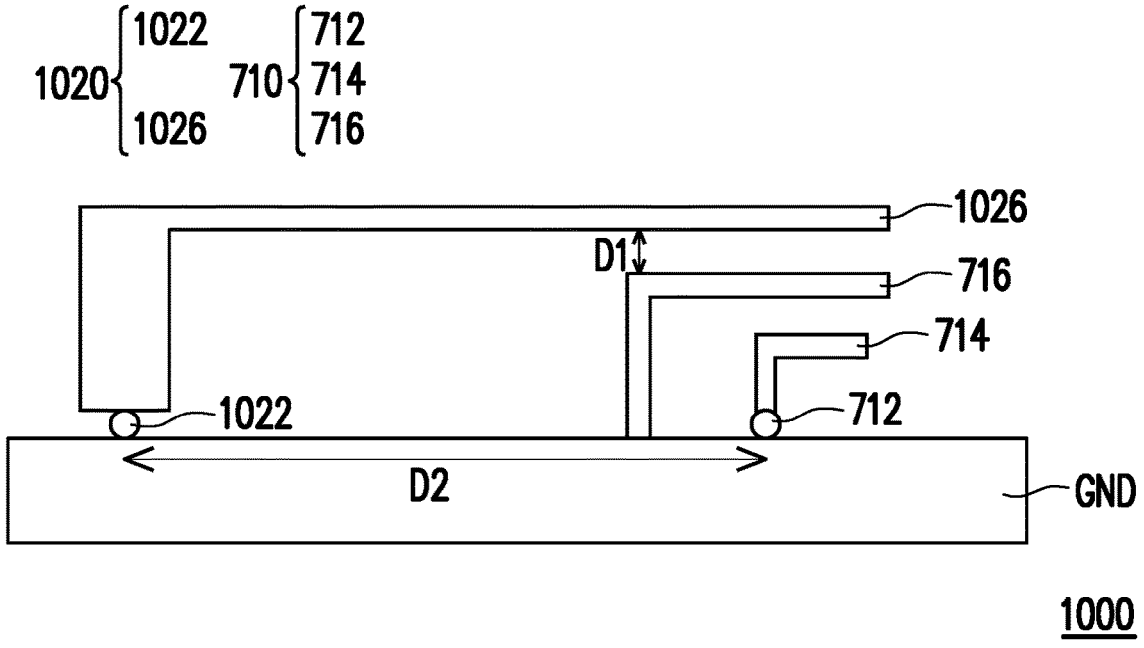
FIG. 10 is a schematic diagram of an antenna structure according to a fourth embodiment of the disclosure.

FIG. 10 is a schematic diagram of an antenna structure according to a fourth embodiment of the disclosure. In FIG. 10, an antenna structure 1000 includes a first coupling antenna 710 and a reference antenna 1020. The first coupling antenna 710 includes a first excitation source 712, a first feeding portion 714, and a first radiator 716. The first excitation source 712 is connected to a ground plane GND and the first feeding portion 714, and may be configured to excite a first resonant mode. In addition, the first radiator 716 may be coupled to the ground plane GND, and may generate a current by being coupled to an excited first excitation source 712 and the first feeding portion 714.

According to this embodiment, the reference antenna 1020 may include a second excitation source 1022 and a second radiator 1026. The second excitation source 1022 is connected between the ground plane GND and the second radiator 1026, and may be configured to excite a second resonant mode. According to the fourth embodiment, the second radiator 1026 may generate a current in response to an excited second excitation source 1022.

According to the first embodiment, a first distance D1 (which is, for example, a shortest distance between the first radiator 716 and the second radiator 1026) may exist between the first radiator 716 and the second radiator 1026, and a second distance D2 may exist between the first excitation source 712 and the second excitation source 1022. The first distance D1 may not be greater than the second distance D2. In addition, the first radiator 716 may be a ¼-wavelength resonance structure, and the second radiator 1026 may be a ¼-wavelength resonance structure. One terminal of the second radiator 1026 may be connected to the ground plane GND through the second excitation source 1022, and an other terminal of the second radiator 1026 may be an open terminal. In addition, a harmonic resonance frequency of the second radiator 1026 (for example, a $3^{rd}$ harmonic resonance frequency) may be same as a fundamental resonance frequency of the first radiator 716.

According to the fourth embodiment, the first coupling antenna 710 may form a first zero current area on the ground plane GND in response to the first resonant mode excited by the first excitation source 712, which is further described in detail with respect to FIG. 7B and therefore will not be repeated in the following. The reference antenna 1020 may form a second zero current area on the ground plane GND in response to the second resonant mode excited by the second excitation source 1022, and the relevant details are similar to mechanism shown in FIG. 7C and therefore will not be repeated in the following. According to embodiments of the disclosure, the so-called zero current area is, for example, an area where no current is flowing or an area where very little current is flowing.

According to the fourth embodiment, the first excitation source 712 may be designed to be located in the second zero current area corresponding to the reference antenna 1020, and the second excitation source 1022 may be designed to be located in the first zero current area corresponding to the first coupling antenna. In this way, isolation between the first coupling antenna 710 and the reference antenna 1020 may be increased to further avoid interference between the first coupling antenna 710 and the reference antenna 1020. Since the fourth embodiment may be understood as replacing the reference antenna of the third embodiment with an uncoupled version, the details of the fourth embodiment may be referred to the relevant description of the third embodiment and will not be repeated in the following.

In addition, in the embodiments of the disclosure, the antenna structures 100, 400, 700, 1000 may be disposed in a communication device (e.g., a smart phone, etc.). Moreover, when the first coupling antennas 110, 410, and 710 are configured as the transmitting antennas of the communication device, the reference antennas 120, 420, 720, and 1020 may be configured to be connected to a proximity sensor of the communication device and serve as an induction metal portion of the proximity sensor. In this case, the communication device may detect proximity of a human body by means of the reference antennas 120, 420, 720, and 1020, and accordingly adjust transmitting power of the first coupling antennas 110, 410 and 710 to comply with relevant requirements of Specific Absorption Rate (SAR).

In summary, by disposing the first excitation source of the first coupling antenna in the second zero current area corresponding to the reference antenna, and disposing the second excitation source of the reference antenna in the first zero current area corresponding to the first coupling antenna, the isolation between the first coupling antenna and the reference antenna may be increased to further avoid interference between the first coupling antenna and the reference antenna.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An antenna structure comprising:

a ground plane;

a first coupling antenna comprising a first excitation source connected to the ground plane, wherein the first excitation source is configured to excite a first resonant mode, and the first coupling antenna forms a first zero current area on the ground plane in response to the first resonant mode; and a reference antenna comprising a second excitation source connected to the ground plane, wherein the second excitation source is configured to excite a second resonant mode, and the reference antenna forms a second zero current area on the ground plane in response to the second resonant mode, wherein the first excitation source is located in the second zero current area, and the second excitation source is located in the first zero current area.

2. The antenna structure according to claim 1, wherein the first coupling antenna further comprises:

a first radiator connected to the ground plane; and a first feeding portion connected to the ground plane through the first excitation source, wherein the first feeding portion is coupled to the first radiator to excite the first resonant mode, and a first current is formed on the first radiator, wherein the first current flows into the ground plane to form a first ground current.

3. The antenna structure according to claim 2, wherein the reference antenna further comprises:

a second radiator, wherein the second radiator and the ground plane generate a first coupling current in response to the first current, a part of the first coupling current of the ground plane offsets a part of the first ground current, and the first zero current area on the ground plane is formed.

4. The antenna structure according to claim 3, wherein the first radiator has at least a first strong current zone and a first weak current zone in response to the first current, and the second radiator has at least a second strong current zone and a second weak current zone in response to the first coupling current, wherein a vertical projection of the first weak current zone on the ground plane at least partially overlaps a vertical projection of the second weak current zone on the ground plane.

5. The antenna structure according to claim 4, wherein a vertical projection of the first strong current zone on the ground plane at least partially overlaps a vertical projection of the second strong current zone on the ground plane.

6. The antenna structure according to claim 4, wherein a first distance exists between the first radiator and the second radiator, a second distance exists between the first excitation source and the second excitation source, and the first distance is not greater than the second distance.

7. The antenna structure according to claim 1, wherein the reference antenna further comprises:

a second radiator exciting the second resonant mode through the second excitation source to form a second current flowing on the second radiator, wherein the ground plane forms a second ground current in response to the second current.

8. The antenna structure according to claim 7, wherein the first coupling antenna further comprises:

a first feeding portion connected to the ground plane through the first excitation source;

a first radiator connected to the ground plane, wherein the first radiator forms a second coupling current flowing on the first radiator and the ground plane in response to the second current, a part of the second coupling current flowing on the ground plane offsets a part of the second ground current, and the second zero current area on the ground plane is formed.

9. The antenna structure according to claim 8, wherein the reference antenna is a second coupling antenna, and the reference antenna further comprises:

a second feeding portion connected to the second excitation source and connected to the ground plane through the second excitation source, wherein the second feeding portion is coupled to the second radiator to excite the second resonant mode, and the second current is formed on the second radiator.

10. The antenna structure according to claim 9, wherein the first radiator is a ¼-wavelength resonance structure, the second radiator is a double-end opening ½-wavelength resonance structure, and a fundamental resonance frequency of the second radiator is same as a fundamental resonance frequency of the first radiator.

11. The antenna structure according to claim 9, wherein the first radiator is a ¼-wavelength resonance structure, the second radiator is a double-end shorting ½-wavelength resonance structure, and a fundamental resonance frequency of the second radiator is same as a fundamental resonance frequency of the first radiator.

12. The antenna structure according to claim 9, wherein the first radiator is a ¼-wavelength resonance structure, the second radiator is a ¼-wavelength resonance structure, and a harmonic resonance frequency of the second radiator is same as a fundamental resonance frequency of the first radiator.

13. The antenna structure according to claim 8, wherein the first radiator has at least a third strong current zone and a third weak current zone in response to the second coupling current, and the second radiator has at least a fourth strong current zone and a fourth weak current zone in response to the second current, wherein a vertical projection of the third weak current zone on the ground plane at least partially overlaps a vertical projection of the fourth weak current zone on the ground plane.

14. The antenna structure according to claim 13, wherein a vertical projection of the third strong current zone on the ground plane at least partially overlaps a vertical projection of the fourth strong current zone on the ground plane.

15. The antenna structure according to claim 7, wherein one terminal of the second radiator is connected to the ground plane through the second excitation source, and an other terminal of the second radiator is an open terminal.

16. The antenna structure according to claim 1, wherein the antenna structure is disposed in a communication device, the first coupling antenna is a transmitting antenna of the communication device, and the reference antenna is an induction metal portion of a proximity sensor of the communication device.

* * * * *